United States Patent [19]

Fitzler et al.

[11] 4,194,801

[45] Mar. 25, 1980

[54] CROSS-CONNECTING COMB FOR ELECTRICAL TERMINALS

[75] Inventors: Arno Fitzler, Herford; Hans-Herbert Kordt, Osterode, both of Fed. Rep. of Germany

[73] Assignee: C. A. Weidmuller KG, Detmold, Fed. Rep. of Germany

[21] Appl. No.: 926,983

[22] Filed: Jul. 21, 1978

[30] Foreign Application Priority Data

Aug. 2, 1977 [DE] Fed. Rep. of Germany ... 7723993[U]

[51] Int. Cl.[2] ..... H01R 13/48; H01R 31/08

[52] U.S. Cl. ..... 339/19; 339/59 M

[58] Field of Search ..... 339/19, 59 R, 59 M, 339/107, 176 MF, 208, 210 R, 210 M, 217 R, 222

[56] References Cited

U.S. PATENT DOCUMENTS

| | | | |
|---|---|---|---|
| 3,319,216 | 5/1967 | McCullough | 339/59 M |
| 3,784,956 | 1/1974 | Gassman | 339/210 M |

FOREIGN PATENT DOCUMENTS

| | | | |
|---|---|---|---|
| 877553 | 8/1971 | Canada | 339/210 M |
| 1394871 | 3/1965 | France | 339/208 |
| 645795 | 11/1950 | United Kingdom | 339/19 |
| 1419416 | 12/1975 | United Kingdom | 339/176 MF |

*Primary Examiner*—Neil Abrams

*Attorney, Agent, or Firm*—Pollock, Vande Sande & Priddy

[57] ABSTRACT

A cross-connecting comb for interconnecting electrical terminals consists of a metal back and metal teeth, and a U-section insulating plastic sheath enclosing the metal back and provided with locking means holding the sheath in position on the metal back, the teeth projecting through apertures in the sheath.

3 Claims, 7 Drawing Figures

CROSS-CONNECTING COMB FOR ELECTRICAL TERMINALS

Figure 1:
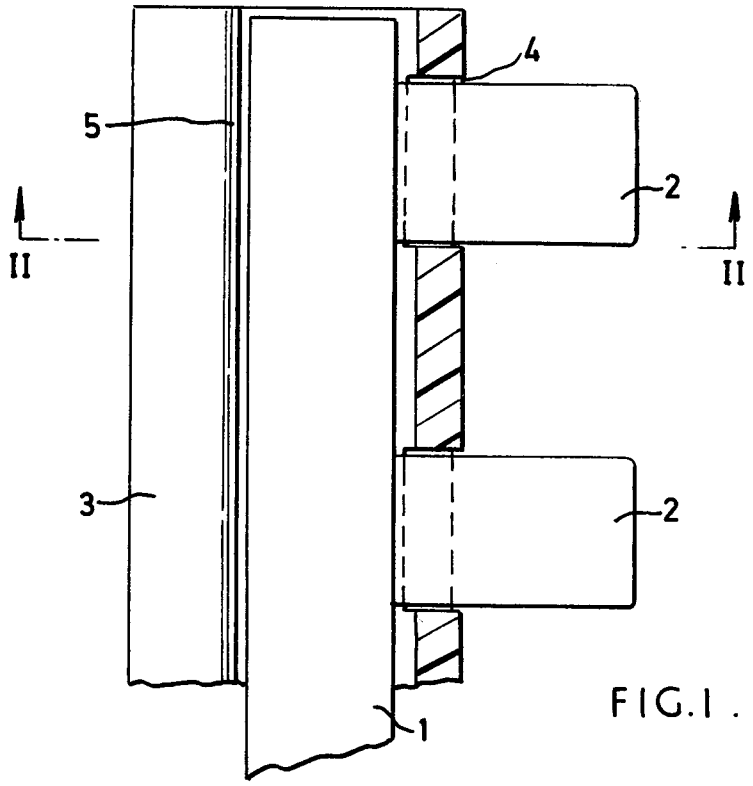

This invention relates to cross-connecting combs for making electrical cross-connections between electrical terminals. Such combs are used, in particular, for making connections between terminals of adjacent terminal blocks of the known clip-on kind mounted side by side to form a terminal strip or assembly, the teeth of the comb being secured by clamping screws of the individual terminals.

For safety, the back of the comb, which is made of metal and electrically interconnects the teeth, is commonly provided with an insulating plastic sheath. The sheaths of known combs are fixedly applied to the comb back, which provides excellent protection against accidental contact with the comb back, but is expensive to produce. It is also known to provide a sheath in the form of a longitudinally slit tube, which is slid onto the comb with the teeth projecting through the slit. The slit tube can be produced by extrusion, therefore cheaply, but in practice does not grip the comb back securely enough for adequate safety.

An object of the present invention is to provide an insulated cross-connecting comb in which the insulating sheath is cheap to produce but nevertheless is held in position securely, so that it cannot accidentally be displaced from the comb back.

According to the present invention, there is provided a comb for making electrical cross-connections between electrical terminals, which comb comprises a plurality of metal teeth and a metal back interconnecting the teeth, and a sheat of insulating plastic material enclosing the metal back of the comb, the sheath being a strip of U-shaped cross-section provided with apertures at one end of the cross-section through which apertures the teeth project, and locking means on at least one limb of the "U" resiliently engaging behind the metal back for retaining the latter within the sheath.

The locking means hold the sheath and comb back together against separation in a direction perpendicular to the length of the comb, and the comb teeth, projecting through the apertures of the sheath, prevent longitudinal relative movement of the sheath and comb. Accidental displacement of the sheath is therefore prevented and reliable protection against accidental touching of the comb back is obtained. Furthermore, a suitable sheath can be produced by extrusion and a blanking or stamping step to form the apertures.

Preferably, the apertures are provided in the base of the U. Alternatively, the apertures may be defined in or by the locking means, for example by gaps between successive discrete locking elements, or gaps provided in longitudinally continuous locking elements. In the latter case, the teeth project from between the limbs of the U.

The sheath may be formed by extrusion in the desired U-section form. Alternatively, the sheath may be formed by folding an initially flat extruded or molded strip of plastic material. In this case, the folding may be carried out before or after assembly of the plastic strip with the metal comb back and teeth. Particularly in the case in which the plastic strip is folded about the comb back, it is advantageous if the locking means serve also to hold the folded strip in its U-section configuration. To facilitate folding, the flat strip may have longitudinal regions of reduced thickness. A flat strip can be extruded particularly simply and easily, and is especially suited to applications in which the comb is to be formed to the desired length and assembled only at the place of use.

The locking means can take any convenient form, e.g., a rib of ratchet-tooth cross-section extending along the inner surface of at least one limb of the U; a continuous or discontinuous rib on one limb of the U engaging a channel on the opposite limb; or buttons on one limb of the U engaging apertures or recesses in the opposite limb.

Preferably, the apertures for the comb teeth are formed by a blanking out operation, in the case of a U-section extrusion or a flat extruded plastic strip. This has the advantage that it is easy to provide the apertures at different spacings, to correspond to different tooth pitches of different combs, either by changing the speed at which the plastic strip passes through the blanking press, or by replacing a particular multiple blanking die with a die of different pitch.

Figure 2:
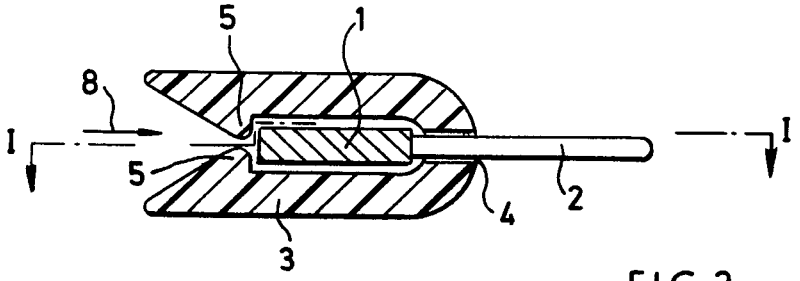
Figure 3:
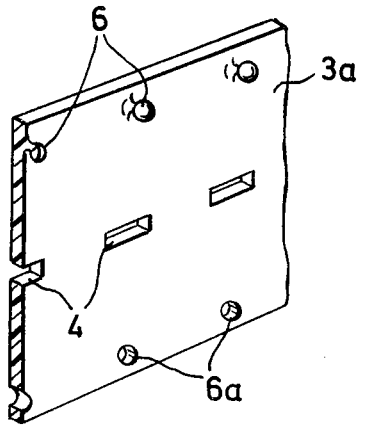
Figure 4:
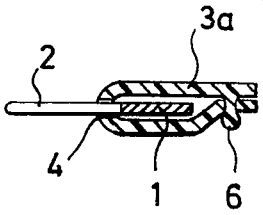
Figure 5:
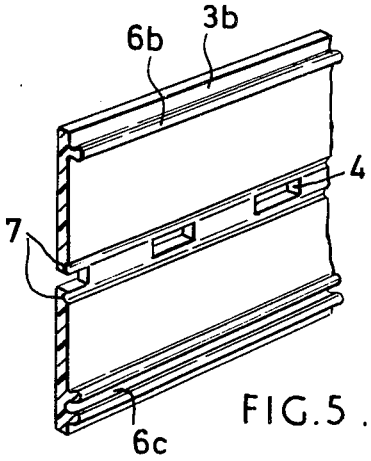
Figure 6:
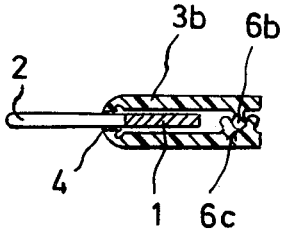
Figure 7:
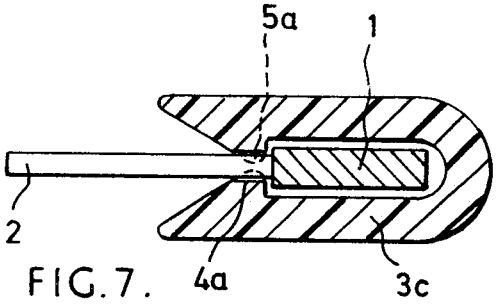

The invention will be further described with reference to the accompanying drawings, in which:

FIG. 1 is a plan view of an end region of a cross-connecting comb embodying the invention, FIG. 2 is a cross section of the comb, on the line II—II of FIG. 1, FIG. 3 shows in perspective part of a flat plastic strip for forming an insulating sheath of a cross-connecting comb, FIG. 4 is a cross section of a comb with a sheath formed from the strip of FIG. 3, FIGS. 5 and 6 are views corresponding to FIGS. 3 and 4, showing a different plastic strip, and FIG. 7 is a cross section through a fourth form of comb embodying the invention.

FIG. 1 shows a cross-connecting comb comprising a plurality of metal teeth 2 integral with or attached to a metal back 1 which is surrounded by an insulating plastic sheath 3. The sheath is a U-section extrusion provided with apertures 4 in the base of the U, through which the comb teeth project. These apertures are formed by a blanking operation on the extruded strip. The comb back is held in the sheath by longitudinal ribs 5 on the inner surfaces of the limbs of the U, these ribs being of ratchet tooth cross-section as can be seen in FIG. 2. The teeth are inserted between the limbs of the U in the direction of the arrow 8, the limbs being thereby pushed apart. When the comb back has fully entered the sheath, the ribs 5 snap into the illustrated position behind the comb back 1, due to the resilience of the plastic material. In an alternative arrangement, only one limb of the sheath has a locking rib 5.

The U-section extrusion can be produced by the yard, being cut to the desired comb length by the user.

FIG. 3 shows a moulded flat plastic strip 3*a*, which has been subjected to a blanking operation to form a central longitudinal line of apertures 4, and a line of holes 6*a* adjacent to one edge. Adjacent to the other edge are locking buttons 6. The teeth of the comb are inserted through the apertures 4, and the flat strip is then folded into a U-section configuration as shown in FIG. 4 enclosing the comb back 1, the buttons 6 being inserted into the holes 6*a* in which they are resiliently retained, thereby holding the plastic strip in its U-section configuration and also locking the comb back within the sheath thus formed.

FIG. 5 shows a flat extruded plastic strip 3*b* with blanked-out apertures 4 which are flanked by longitudinal fold lines defined by regions 7 of reduced thickness. Adjacent to one edge of the flat strip is a continuous longitudinal rib 6b, and adjacent to the other edge of the flat strip is a pair of continuous longitudinal ribs defining therebetween a locking channel 6c. The ribs are undercut so that, after insertion of the comb teeth into the apertures 4 and folding of the flat strip about the comb back, the rib 6b can be snapped into the channel 6c where it is held by the resilience of the plastic material, as shown in FIG. 6.

Alternatively, an extruded flat plastic strip can be folded before insertion of the metal comb, being fixed in U-section configuration, e.g., by heat treatment, and in this case the locking means can be, for example, one or more ribs of the kind shown in FIG. 2. Conversely, a sheath comprising a U-section extrusion can be provided with interengaging locking means, such as those shown in FIGS. 5 and 6, interengagement thereof being effected after insertion of the metal comb teeth and back.

FIG. 7 shows a further arrangement in which the sheath 3c is a U-section extrusion but in which the base region of the U is not perforated. Instead, the comb teeth 2 project from between the limbs of the U through apertures defined by gaps or recesses 4a in one or two longitudinal ratchet tooth-section ribs 5a. Between these gaps or recesses, the rib projects, or the ribs project, between the comb teeth and thereby prevent longitudinal relative displacement of the metal comb and the plastic sheath. As in the case of FIG. 2, the comb back is inserted into the sheath between the ribs 5a, pushing apart the ribs which then snap into their locking position when the comb back is fully inserted.

We claim:

1. A comb for making electrical cross-connection between electrical terminals, said comb comprising (a) a multiplicity of metal teeth and a metal back interconnecting said teeth, and (b) a unitary sheath of resilient insulating plastic material enclosing the back of said comb, said sheath comprising (i) an extruded strip having a cross section in the shape of a "U" and provided with apertures at one end of the cross section through which apertures said teeth project, and (ii) an integral locking rib of ratchet-tooth cross section extending along the inner surface of at least one leg of the "U" adjacent to the free end of said leg, the legs of the "U" being deflectable for permitting insertion of said back, and said rib engaging behind said back due to the resilience of said sheath, for retaining said back within said sheath.

2. A comb according to claim 1, wherein said apertures are located in the base of the "U".

3. A comb according to claim 1, wherein said locking rib is gapped to define said apertures.

* * * * *